US010960524B2

(12) United States Patent
Hung et al.

(10) Patent No.: US 10,960,524 B2
(45) Date of Patent: Mar. 30, 2021

(54) NAIL GUN AND SWITCHABLE TRIGGER DEVICE THEREOF

(71) Applicant: Basso Industry Corp., Taichung (TW)

(72) Inventors: Liang-Chi Hung, Taichung (TW); Li-Hsin Chang, Taichung (TW)

(73) Assignee: Basso Industry Corp., Taichung (TW)

( * ) Notice: Subject to any disclaimer, the term of this patent is extended or adjusted under 35 U.S.C. 154(b) by 130 days.

(21) Appl. No.: 16/247,790

(22) Filed: Jan. 15, 2019

(65) Prior Publication Data

US 2019/0217457 A1 Jul. 18, 2019

(30) Foreign Application Priority Data

Jan. 17, 2018 (TW) ..... 107101664 A

(51) Int. Cl.
*B25C 1/04* (2006.01)
*B25C 1/00* (2006.01)

(52) U.S. Cl.
CPC ..... *B25C 1/043* (2013.01); *B25C 1/008* (2013.01); *B25C 1/047* (2013.01)

(58) Field of Classification Search
CPC ..... B25C 1/043; B25C 1/008; B25C 1/047
USPC ..... 227/130, 120, 8
See application file for complete search history.

(56) References Cited

U.S. PATENT DOCUMENTS 4,629,106 A * 12/1986 Howard ..... B25C 1/008 227/130
6,357,647 B1 * 3/2002 Ou ..... B25C 1/008 227/10
6,450,387 B1 * 9/2002 Chen ..... B25C 1/008 227/130
6,953,137 B2 * 10/2005 Nakano ..... B25C 1/008 227/130
7,721,928 B2 * 5/2010 Chen ..... B25C 1/008 227/8
8,109,425 B2 * 2/2012 Liu ..... B25F 5/00 227/8
2001/0006183 A1 * 7/2001 Mukoyama ..... B25C 1/008 227/8
2006/0000863 A1 * 1/2006 McGee ..... B25C 1/008 227/8
2006/0191973 A1 * 8/2006 Chen ..... B25C 5/1603 227/123
2009/0159633 A1 * 6/2009 Wu ..... B25C 1/008 227/8

* cited by examiner

*Primary Examiner* — Nathaniel C Chukwurah
(74) *Attorney, Agent, or Firm* — Burris Law, PLLC

(57) ABSTRACT

A nail gun includes a gun body, a power module, a muzzle module and an switchable trigger module. The muzzle module includes a contact arm resiliently maintained at a normal position. The switchable trigger module includes a transmission unit, a trigger arm unit and a trigger unit. The transmission unit includes a transmission member that is connected to the contact arm. The trigger unit includes a trigger member and a blocking member. The trigger member is operable to move between a sequential firing position and a repetitive firing position.

22 Claims, 15 Drawing Sheets

NAIL GUN AND SWITCHABLE TRIGGER DEVICE THEREOF

CROSS-REFERENCE TO RELATED APPLICATION

This application claims priority of Taiwanese Invention Patent Application No. 107101664, filed on Jan. 17, 2018.

FIELD

The disclosure relates to a nail gun, and more particularly to a nail gun and a switchable trigger device thereof.

BACKGROUND

A conventional nail gun disclosed in U.S. Pat. No. 6,953,137 includes a main housing, a contact arm that is movably mounted to the main housing, a trigger that is pivoted to the main housing, a trigger arm that is mounted in the trigger, and a plunger that is movably mounted in the main housing. When the contact arm is pushed against an object, a tip end portion of the trigger arm is blocked by the contact arm so that depression of the trigger drives the trigger arm to move the plunger for firing a nail. However, after the firing of the nail, the tip end portion of the trigger arm is configured to be removed from the path of movement of the contact arm, so as not to be blocked by the contact arm. Therefore, the plunger cannot be moved again for firing another nail unless the trigger is released.

SUMMARY

Therefore, an object of the disclosure is to provide a nail gun that can alleviate the drawback of the prior art.

According to the disclosure, the nail gun includes a gun body, a power module, a muzzle module and an switchable trigger module. The power module is disposed in the gun body, and is configured to perform a nail-driving operation in which the power module outputs power to strike a nail. The muzzle module is mounted to the gun body, and includes a nail exit opening and a contact arm. The contact arm has an abutment front end, and is resiliently maintained at a normal position. The contact arm is operable to move in a nail-exit direction away from the normal position such that the abutment front end projects relative to the nail exit opening. The switchable trigger module is operable to activate the nail-driving operation for firing the nail via the nail exit opening. The switchable trigger module includes a transmission unit, a trigger arm unit and a trigger unit. The transmission unit includes a transmission member that is connected to the contact arm. The trigger arm unit abuts against the transmission member at least in a normal state. The trigger unit includes a trigger member that is pivoted to the gun body and that is movable relative to the gun body, and a blocking member that is mounted to the trigger member. The trigger member interacts with the trigger arm unit, and is operable to move between a sequential firing position and a repetitive firing position. When the trigger member is at the sequential firing position and when the trigger member is depressed with the abutment front end of the contact arm not being blocked, the trigger arm unit is configured to push the transmission member to move the contact arm away from the normal position in the nail-exit direction, and the blocking member is configured to block the trigger arm unit so as to prevent the trigger arm unit from moving in a direction opposite to the nail-exit direction, such that the nail-driving operation is prevented from being activated by operation of the contact arm.

Another object of the disclosure to provide a switchable trigger device that can alleviate the drawback of the prior art.

According to the disclosure, the switchable trigger device for use in a nail gun and for activating a nail-driving operation. The nail gun has a nail exit opening. The switchable trigger device includes contact arm, a transmission member, a trigger arm unit and a trigger unit. The contact arm is disposed on the nail gun, and has an abutment front end. The contact arm is resiliently maintained at a normal position, and is operable to move in a nail-exit direction away from the normal position such that the abutment front end projects relative to the nail exit opening. The transmission member is connected to the contact arm. The trigger arm unit abuts against the transmission member at least in a normal state. The trigger unit includes a trigger member that is pivoted to the gun body and that is movable relative to the gun body, and a blocking member that is mounted to the trigger member. The trigger member interacts with the trigger arm unit, and is operable to move between a sequential firing position and a repetitive firing position. When the trigger member is at the sequential firing position and when the trigger member is depressed with the abutment front end of the contact arm not being blocked, the trigger arm unit is configured to push the transmission member to move the contact arm away from the normal position in the nail-exit direction, and the blocking member is configured to block the trigger arm unit so as to prevent the trigger arm unit from moving in a direction opposite to the nail-exit direction, such that the nail-driving operation is prevented from being activated by operation of the contact arm.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
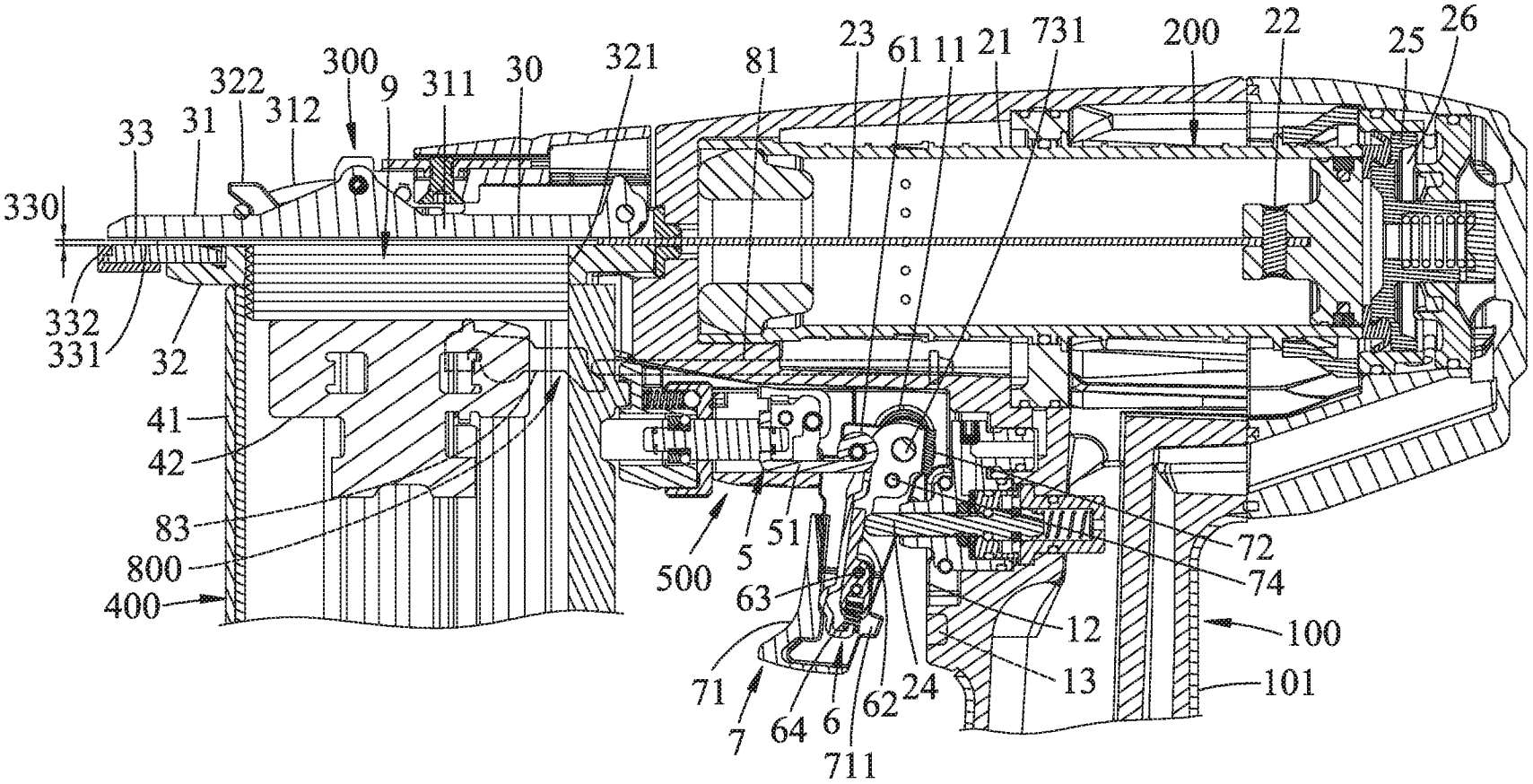
FIG. 1 is a fragmentary sectional view illustrating an embodiment of the nail gun according to the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
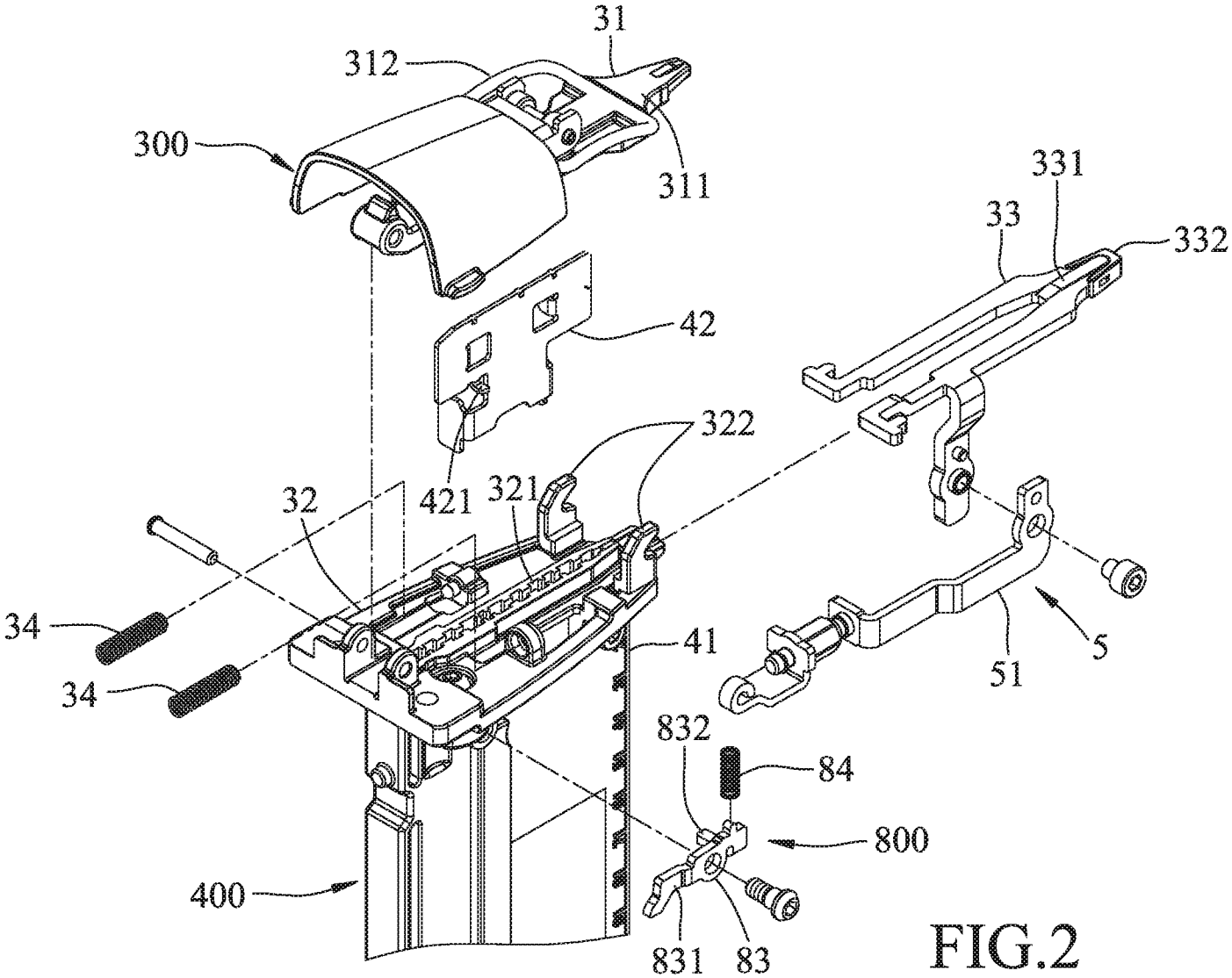
FIG. 2 is a fragmentary, partly exploded perspective view illustrating a muzzle module of the embodiment.
Figure 3:
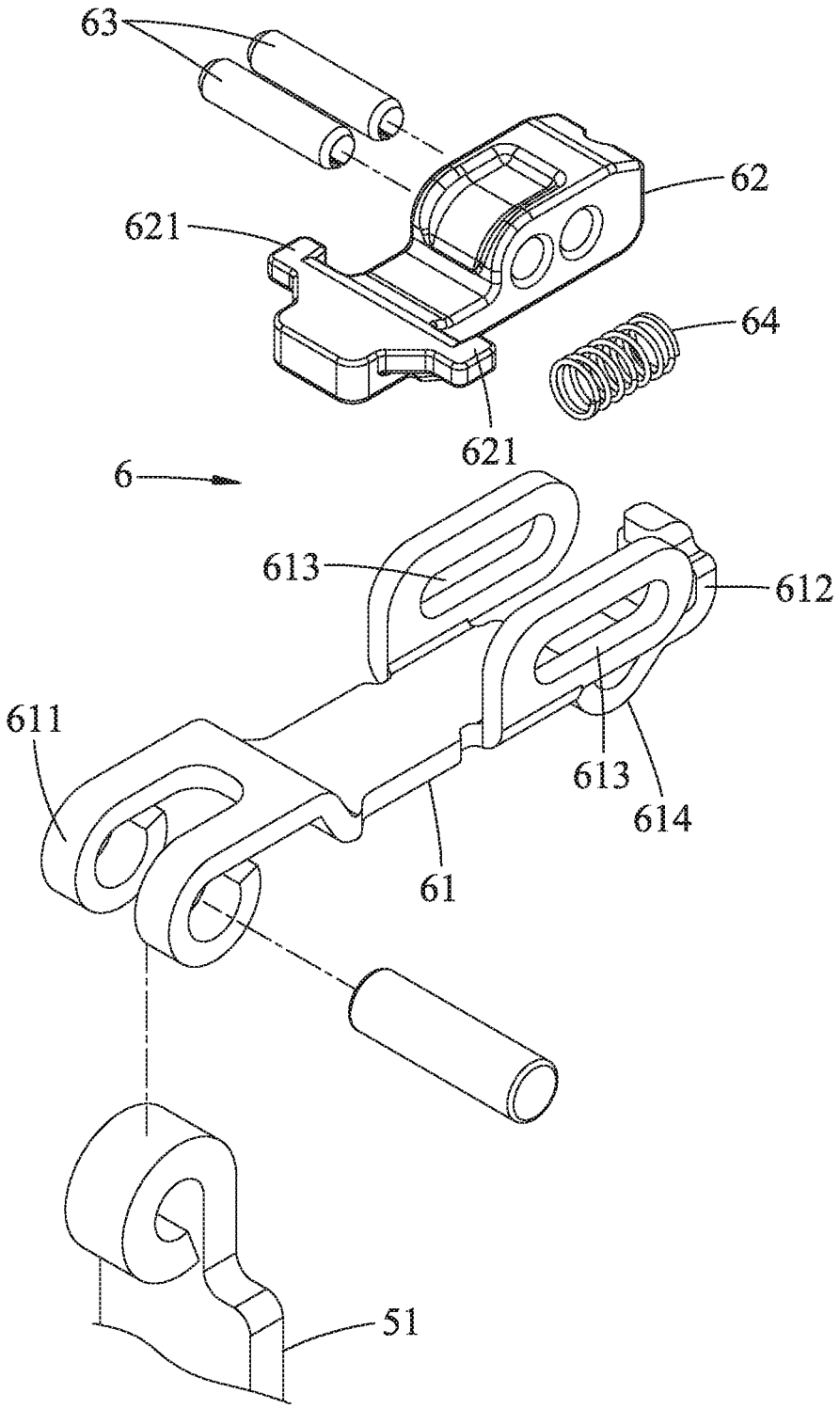
FIG. 3 is a fragmentary exploded perspective view illustrating a trigger arm unit of the embodiment.
Figure 4:
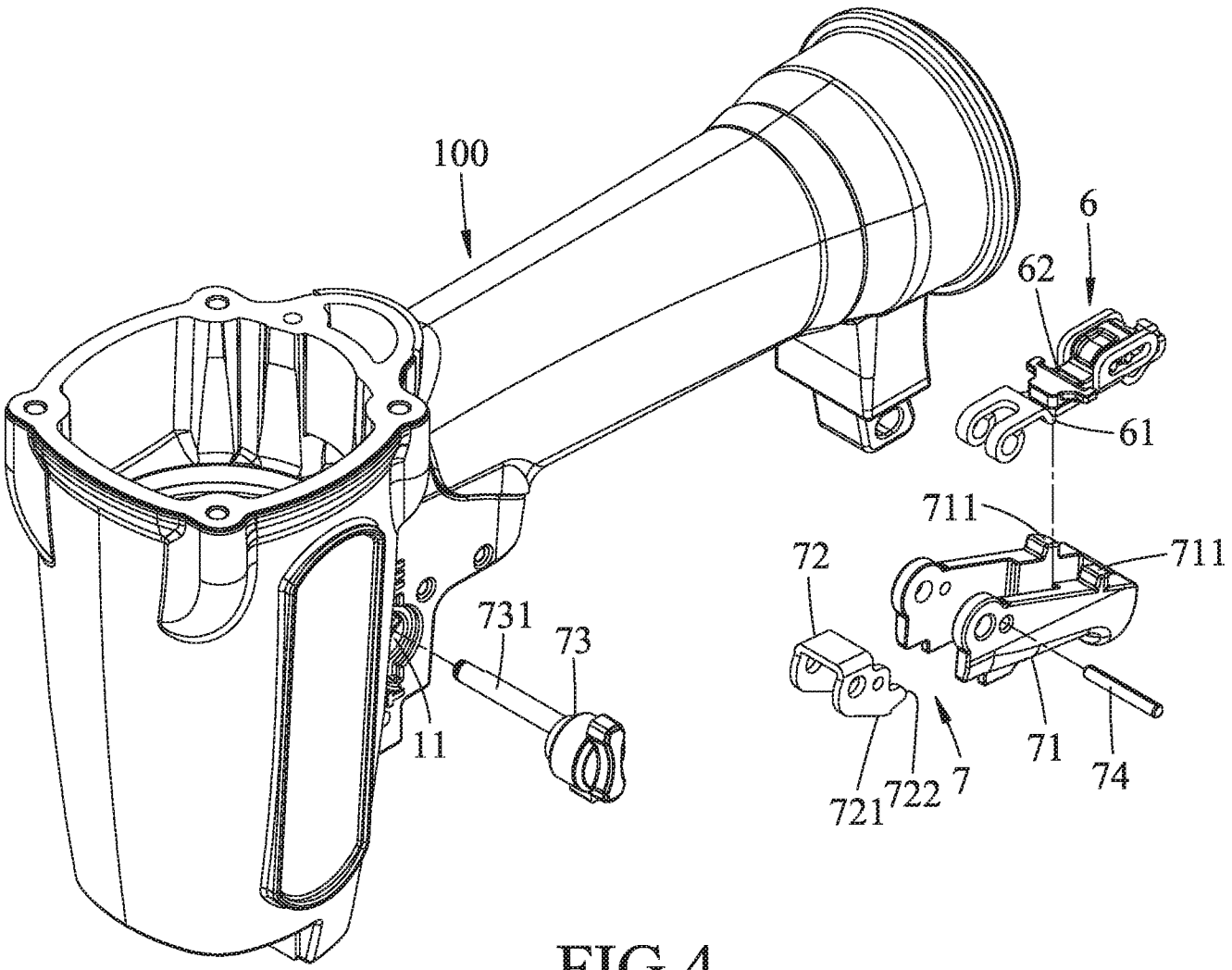
FIG. 4 is an exploded perspective view illustrating a trigger unit of the embodiment.
Figure 5:
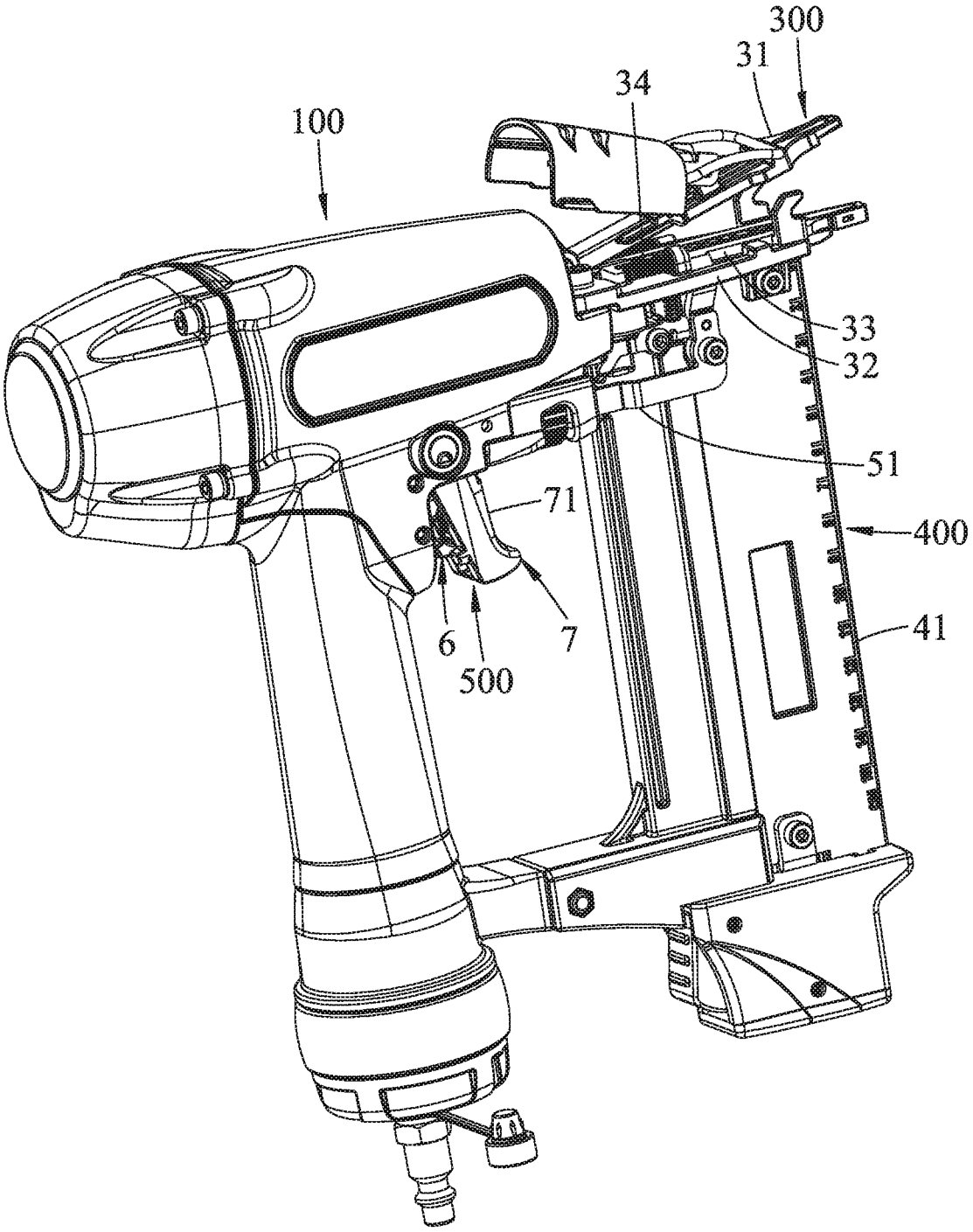
FIG. 5 is a perspective view of the embodiment.

Referring to FIGS. 1 and 2, the embodiment of the nail gun includes a gun body 100, a power module 200, a muzzle module 300, a magazine module 400, a switchable trigger module 500 and a detection module 800. The gun body 100 has a handle 101. For convenience sake, in the following paragraphs, the handle 101 is denoted as the lower portion of the nail gun, the muzzle module 300 is denoted as the front portion of the nail gun, and the rest can be deduced by analogy.

The gun body 100 further has a positioning hole 11 that is disposed adjacent to the handle 101, a first stop structure 12, a second stop structure 13 that is disposed below the first stop structure 12, and a flow path 14 (see FIGS. 14 and 15) that is disposed adjacent to the magazine module 400. The second stop structure 13 is recessed rearwardly relative to the first stop structure 12 away from the muzzle module 300. In one embodiment, the first stop structure 12 is configured as a plane, and the second stop structure 13 is configured as a recess.

The power module 200 is disposed in the gun body 100, and is configured to perform a nail-driving operation in which the power module 200 outputs power to strike a nail. In one embodiment, the power module 200 uses high-pressure air as the power source, and includes a cylinder 21 that is mounted in the gun body 100, a piston 22 that is movably disposed in the cylinder 21, a drive bit 23 that is co-movably mounted to the piston 22, a plunger 24 that is operable for introducing the high-pressure air into the cylinder 21, a head valve 25 that removably blocks the cylinder 21, and a release chamber 26 that is defined between the head valve 25 and the gun body 100 and that is in communication with the flow path 14.

When the plunger 24 is not operated (see FIG. 1), the head valve 25 is biased by the high-pressure air in the release chamber 26 to block the cylinder 21 so that the high-pressure air cannot flow into the cylinder 21. When the plunger 24 is operated to move to an activating position (see FIG. 8), the high-pressure air in the release chamber 26 is released via the flow path 14 so that the head valve 25 unblocks the cylinder 21 and that the high-pressure air flows into the cylinder 21 to push the piston 22 and the drive bit 23 for striking nails (i.e., the nail-driving operation is activated). The abovementioned operation is the same as that of a conventional pneumatic nail gun. In some embodiment, the power module 200 may use gas or electric motor as the power source. The operation of a gas nail gun or an electric nail gun is well-understood to one having ordinary skill in the art, and is not further described in the following paragraphs.

The muzzle module 300 is mounted to a front portion of the gun body 100. In one embodiment, the muzzle module 300 includes a cover plate 31, a middle plate 32 that cooperates with the cover plate 31 to define a nail path 30 therebetween, a contact arm 33 that is substantially disposed between the cover plate 31 and the middle plate 32 and that is movable in a front-rear direction relative to the gun body 100, and two safety resilient members 34. The cover plate 31 includes a plate member 311, and a fastening assembly 312 that is pivoted to the plate member 311. The middle plate 32 has a nail entrance opening 321, and two hook portions 322 that are respectively located at two opposite lateral sides of the cover plate 31. The hook portions 322 can be separably held by the fastening assembly 312 so that the cover plate 31 is removably positioned relative to the middle plate 32. The contact arm 33 has an upper surface 331 that cooperates with the cover plate 31 to define a nail exit opening 330, and an abutment front end 332. Each of the safety resilient members 34 has two opposite ends respectively abutting against the contact arm 33 and the middle plate 35, and resiliently biases the contact arm 33 rearwardly for maintaining the contact arm 33 at a normal position.

The magazine module 400 includes a magazine housing 41 that is connected to the muzzle module 300 and that is adapted to receive a plurality of nails 9 therein, and a nail feeder 42 that is movably disposed in the magazine housing 41 and that pushes the nails 9 toward the nail entrance opening 321 for moving the nails 9 into the nail path 30 one at a time. The nail feeder 42 has a projection 421 (see FIG. 6) that projects toward the outside of the magazine housing 41.

Referring to FIGS. 2 to 5, the switchable trigger module 500 is operable to activate the abovementioned nail-driving operation for firing the nail 9 in in the nail path 30 via the nail exit opening 330. The switchable trigger module 500 includes a transmission unit 5, a trigger arm unit 6 and a trigger unit 7.

The transmission unit 5 includes a transmission member 51 that is co-movably connected to the contact arm 33.

The trigger arm unit 6 includes a trigger arm 61, a sliding block 62, at least one connecting rod 63 and a block resilient member 64. The trigger arm 61 has an upper portion 611 that is pivotally connected to a rear end of the transmission member 51, a free lower portion 612 that is opposite to the upper portion 611, two elongated guide grooves 613 that are formed between the upper and lower portions 611, 612, and an abutment wall 614 that protrudes away from the plunger 24. The sliding block 62 has two projections 621 respectively at two opposite lateral sides thereof. The connecting rod 63 is mounted to the sliding block 62, and has two opposite ends respectively slidable within the guide grooves 613 of the trigger arm 61 so that the sliding block 62 is movable relative to the trigger arm 61 along the guide grooves 613. The block resilient member 64 has two opposite ends respectively abutting against the sliding block 62 and the lower portion 612 of the trigger arm 61, and resiliently biases the sliding block 62 away from the lower portion 612 of the trigger arm 61 (toward the upper portion 611). In some embodiment, the trigger arm 61 abuts against the transmission member 51 in a normal state.

The trigger unit 7 is mounted to the gun body 100, and includes a trigger member 71, a blocking member 72, a switch member 73 and a limiting rod 74.

The trigger member 71 has an abutment portion 711, a first urging surface 712 and a second urging surface 713, all of which face rearwardly. The second urging surface 713 is disposed below the first urging surface 712. The first urging surface 712 is recessed forwardly relative to the second urging surface 713 away from the plunger 24. The abutment portion 711 is operable to correspond in position to the first stop structure 12 or the second stop structure 13.

The blocking member 72 has two teeth 721 protruding toward the transmission member 51, and two end walls 722 at an end portion thereof distal from the gun body 100.

The switch member 73 is rotatably mounted to the positioning hole 11 of the gun body 100, and has an eccentric axle portion 731 that is eccentric with respect to an axis about which the switch member 73 rotates relative to the gun body 100 and that extends through the trigger member 71 and the blocking member 72. The limiting rod 74 extends through the trigger member 71 and the blocking member 72 for limiting movement of the blocking member 72 relative to the trigger member 71. The switch member 73 is rotatable relative to the gun body 100 to move the trigger member 71 between a sequential firing position (see FIGS. 1 and 6 to 9), where the eccentric axle portion 731 of the switch member 73 is proximal to the plunger 24 and the abutment wall 614 of the trigger arm 61 abuts against the first urging surface 712 of the trigger member 71, and a repetitive firing position (see FIGS. 10 to 13), where the eccentric axle portion 731 of the switch member 73 is distal from the plunger 24 and the abutment wall 614 of the trigger arm 61 abuts against the second urging surface 713 of the trigger member 71. When the switch member 73 moves the trigger member 71 from the sequential firing position to the repetitive firing position, the trigger member 71 and the blocking member 72 are moved upwardly. The abutment portion 711 of the trigger member 71 corresponds in position to the first stop structure 12 when the trigger member 71 is at the repetitive firing position, and corresponds in position to the second stop structure 13 when the trigger member 71 is at the sequential firing position. The first urging surface 712 and the second urging surface 713 of the trigger member 71 are configured to maintain relative position between each of the teeth 721 of the blocking member 72 and a respective one of the projections 621 of the sliding block 62.

Referring to FIGS. 1, 2, 14 and 15, the detection module 800 includes a valve rod 81 that is mounted to the gun body 100 and that is movable between an unsealing position (see FIG. 14) and a sealing position (see FIG. 15), a valve resilient member 82 that has two opposite ends respectively abutting against the gun body 100 and the valve rod 81, a detection member 83 that is disposed on the magazine housing 41, and a detection resilient member 84 (see FIG. 2) that has two opposite ends respectively abutting against the detection member 83 and the middle plate 32. When the valve rod 81 is at the unsealing position, the flow path 14 is unsealed, so the high-pressure air in the release chamber 26 can be released via the flow path 14 upon movement of the plunger 24 to the activating position. When the valve rod 81 is at the sealing position, the flow path 14 is sealed, so the high-pressure air in the release chamber 26 cannot be released. The valve resilient member 82 resiliently biases the valve rod 81 toward the sealing position. The detection member 83 is pivoted to the magazine housing 41, and has a first arm portion 831, and a second arm portion 832 that is located on the path of movement of the projection 421 of the nail feeder 42. The detection resilient member 84 resiliently biases the second arm portion 832 such that when the projection 421 of the nail feeder 42 is spaced apart from the second arm portion 832, the first arm portion 831 pushes the valve rod 81 against the biasing action of the valve resilient member 82 to maintain the valve rod 81 at the unsealing position. When the amount of the nails 9 in the magazine housing 41 is less than a predetermined number, the projection 421 of the nail feeder 42 pushes and moves the second arm portion 832 against the biasing action of the detection resilient member 84 such that the first arm portion 831 is partially removed from the path of movement of the valve rod 81 and that the valve rod 81 is moved to and maintained at the sealing position by the valve resilient member 82.

When the trigger member 71 is not depressed (see FIGS. 1 and 10), the contact arm 33 is maintained at the normal position by the safety resilient members 34. At this time, the projections 621 of the sliding block 62 are configured not to interfere with the blocking member 72.

Figure 6:
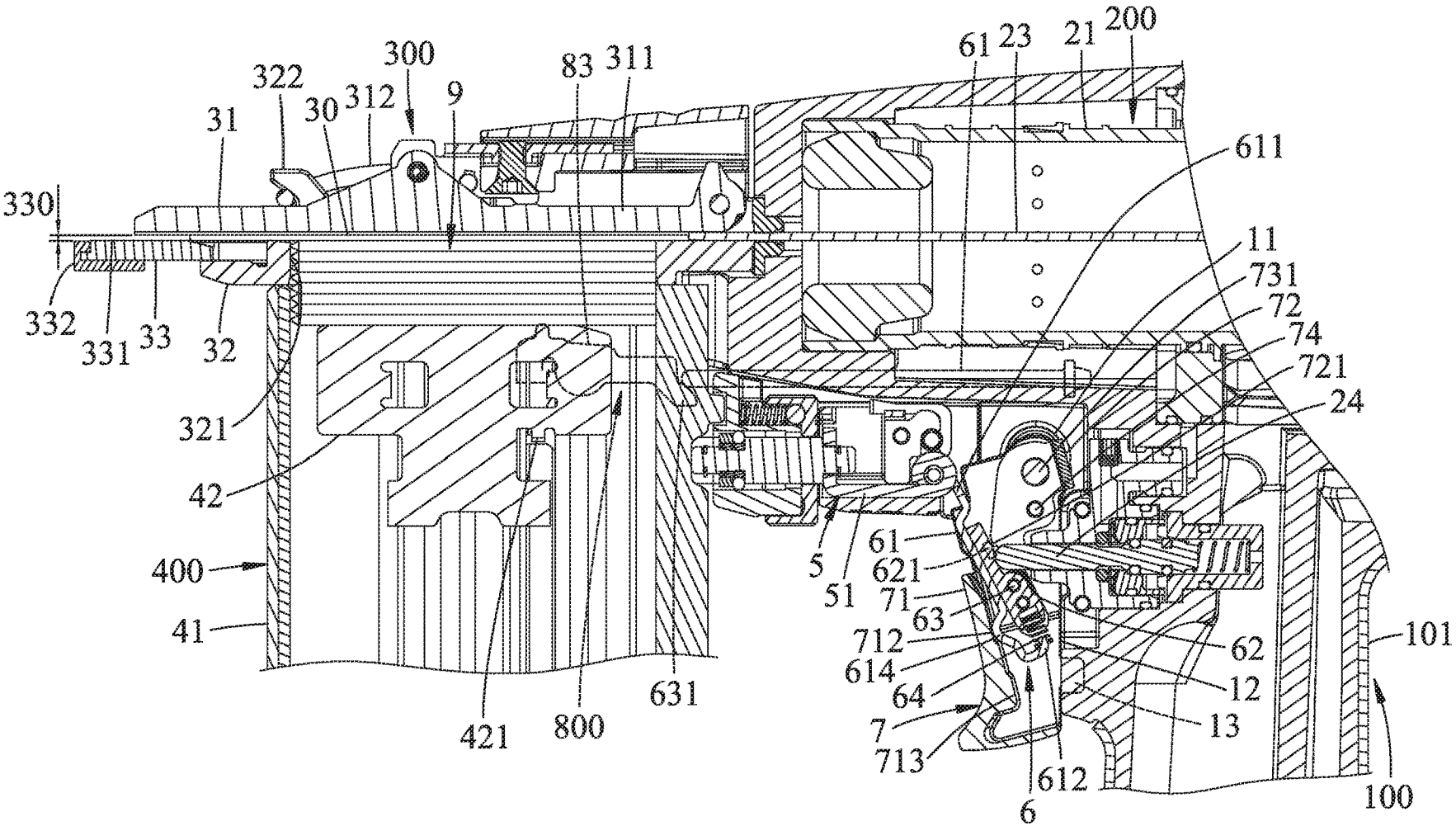
FIG. 6 is a fragmentary sectional view illustrating a trigger member of the embodiment at a sequential firing position.

Referring to FIG. 6, when the trigger member 71 is at the sequential firing position and when the trigger member 71 is depressed toward to handle 101 with the abutment front end 332 of the contact arm 33 not being pushed against an object (i.e., the contact arm 33 is not blocked), the trigger arm 61 is blocked by the plunger 24 and substantially rotates about a front end of the plunger 24, so that the upper portion 611 of the trigger arm 61 is permitted to move forwardly to push and move the contact arm 33 and the transmission member 51 forwardly in a nail-exit direction against the biasing action of the safety resilient members 34, such that the abutment front end 332 of the contact arm 33 projects relative to the nail exit opening 330.

Figure 7:
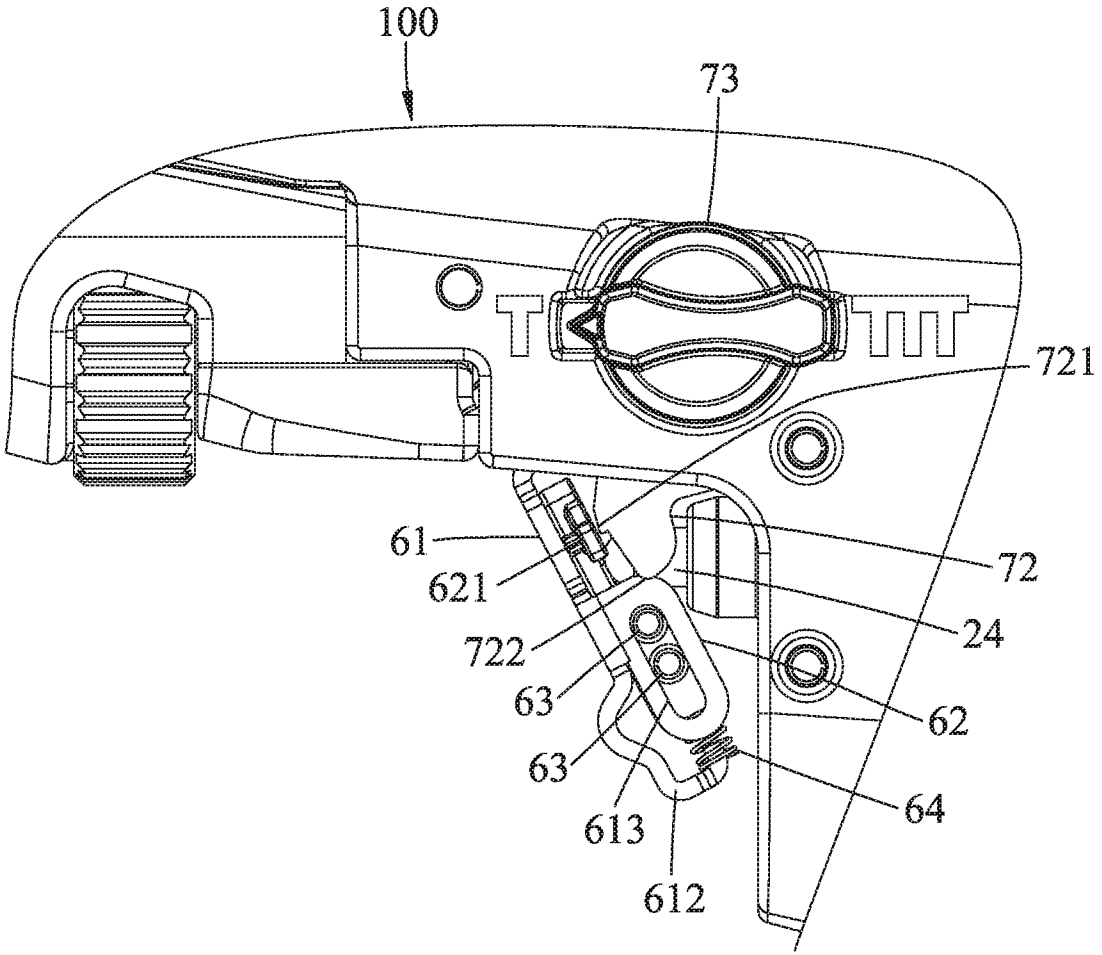
FIG. 7 is a fragmentary side view illustrating the trigger member at the sequential firing position.

Referring further to FIG. 7, upon the depression of the trigger member 71, the trigger arm 61 is driven by the movement of the trigger member 71 to rotate so that the projections 621 of the sliding block 62 can be moved to be aligned with the teeth 721 of the blocking member 72 in a front-rear direction. As such, when the contact arm 33 is pushed rearwardly, the sliding block 62 is hindered by the blocking member 72 so that the plunger 24 cannot be moved to the activating position for activating the nail-driving operation.

Figure 8:
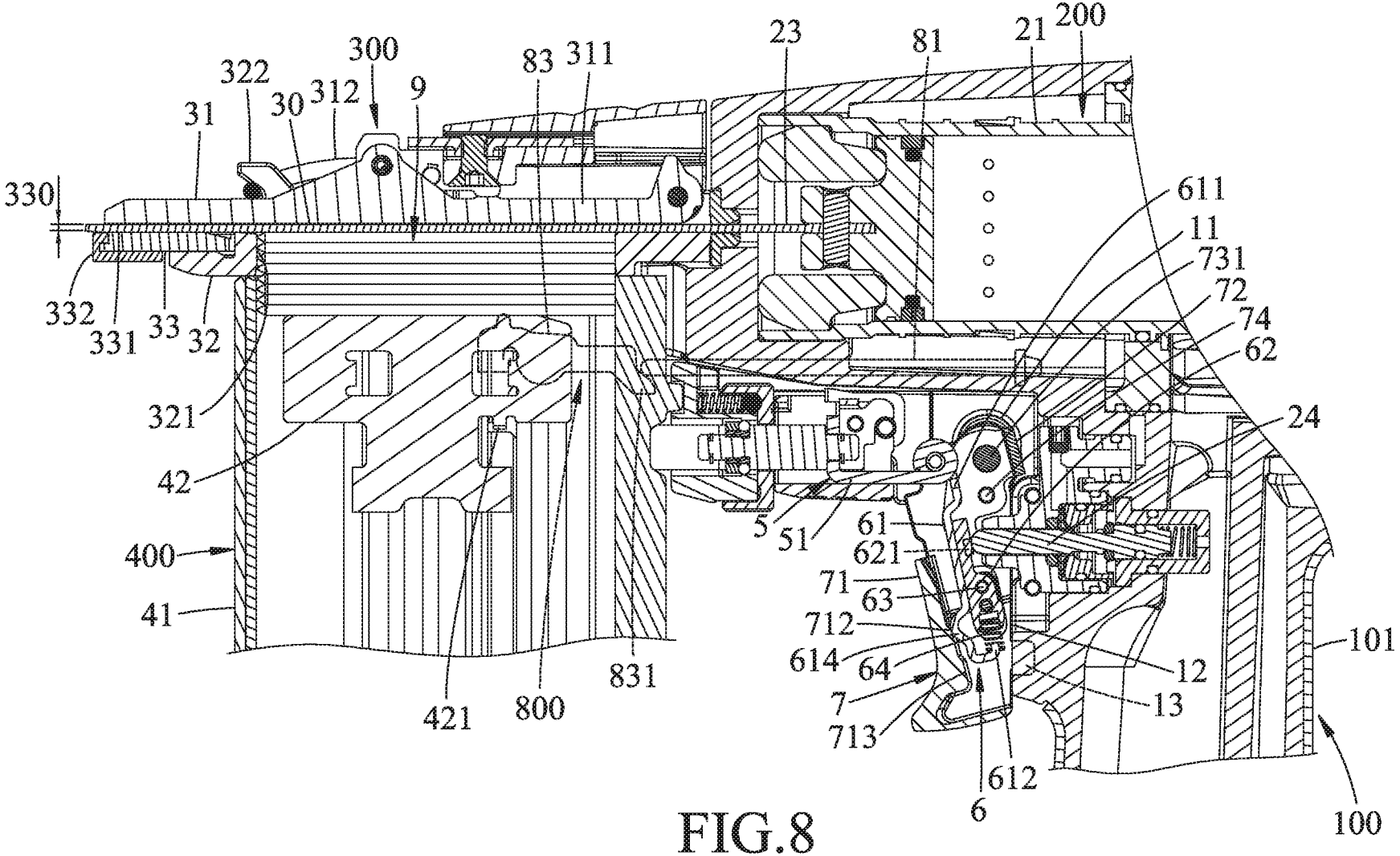
FIG. 8 is a fragmentary sectional view illustrating the trigger member at the sequential firing position.
Figure 9:
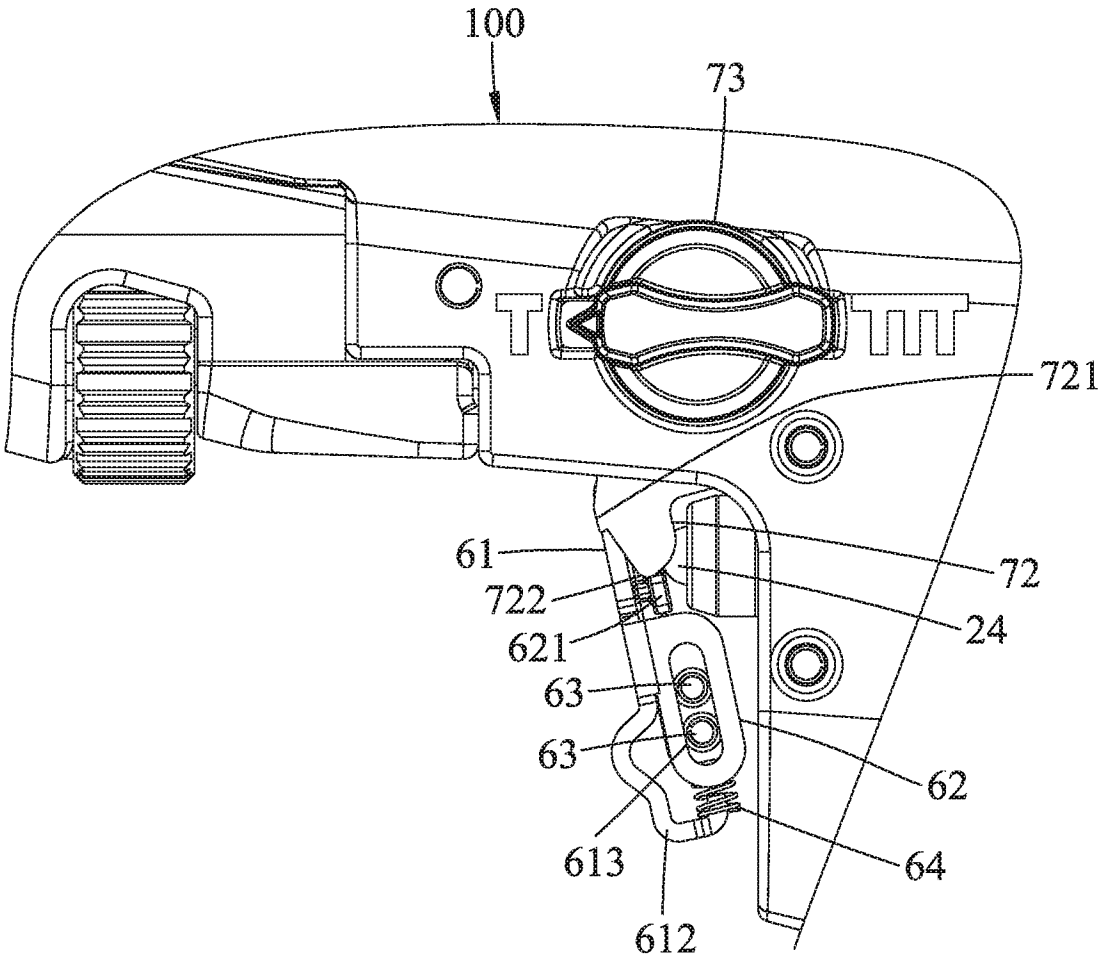
FIG. 9 is a fragmentary side view illustrating the trigger member at the sequential firing position.

Referring to FIG. 8, when the trigger member 71 is at the sequential firing position and when the trigger member 71 is depressed toward the handle 101 with the abutment front end 332 of the contact arm 33 being pushed against an object (not shown) (i.e., the contact arm 33 is blocked), the trigger arm 61 rotates about the rear end of the transmission member 51, so that the lower portion 612 of the trigger arm 61 is permitted to rotate rearwardly. Referring further to FIG. 9, upon the depression of the trigger member 71, the end walls 722 of the blocking member 72 respectively push the projections 621 of the sliding block 62 to move the sliding block 62 relative to the trigger arm 61 along the guide grooves 613 against the biasing action of the block resilient member 64, so that the trigger arm 61 is permitted to push and move the plunger 24 to the activating position for activating the nail-driving operation. Since the second stop structure 13 is recessed rearwardly relative to the first stop structure 12, when the trigger member 71 is at the sequential firing position, the trigger member 71 is permitted to rotate by a relatively large range to abut against the second stop structure 13 so that the trigger arm 61 can sufficiently move the plunger 24 to the activating position.

When the nail-driving operation is activated, the high-pressure air flows into the cylinder 21 to push and move the piston 22 and the drive bit 23 for firing the nail 9 in the nail path 30 via the nail exit opening 330.

At the instant that the nail 9 is struck, the nail gun would be moved away from the object by a reaction force. When the trigger member 71 remains to be depressed, the trigger arm 61 is pushed forwardly by the plunger 24 during the abovementioned movement of the nail gun away from the object. The upper portion 611 of the trigger arm 61 pushes and moves the contact arm 33 and the transmission member 51 forwardly against the biasing action of the safety resilient members 34. After the projections 621 of the sliding block 62 deviate from the end walls 722 of the blocking member 72, the block resilient member biases the sliding block 62 away from the lower portion 612 of the trigger arm 61 so that the projections 621 of the sliding block 62 are moved to be aligned with the teeth 721 of the blocking member 72 in the front-rear direction (with reference to FIG. 7). As described above, when the contact arm 33 is pushed rearwardly, the sliding block 62 is hindered by the blocking member 72 so that the plunger 24 cannot be moved to the activating position for activating the nail-driving operation. The plunger 24 cannot be moved again to activate the nail-driving operation unless the trigger member 71 is released (i.e., the nail gun is in a sequential firing mode).

Figure 10:
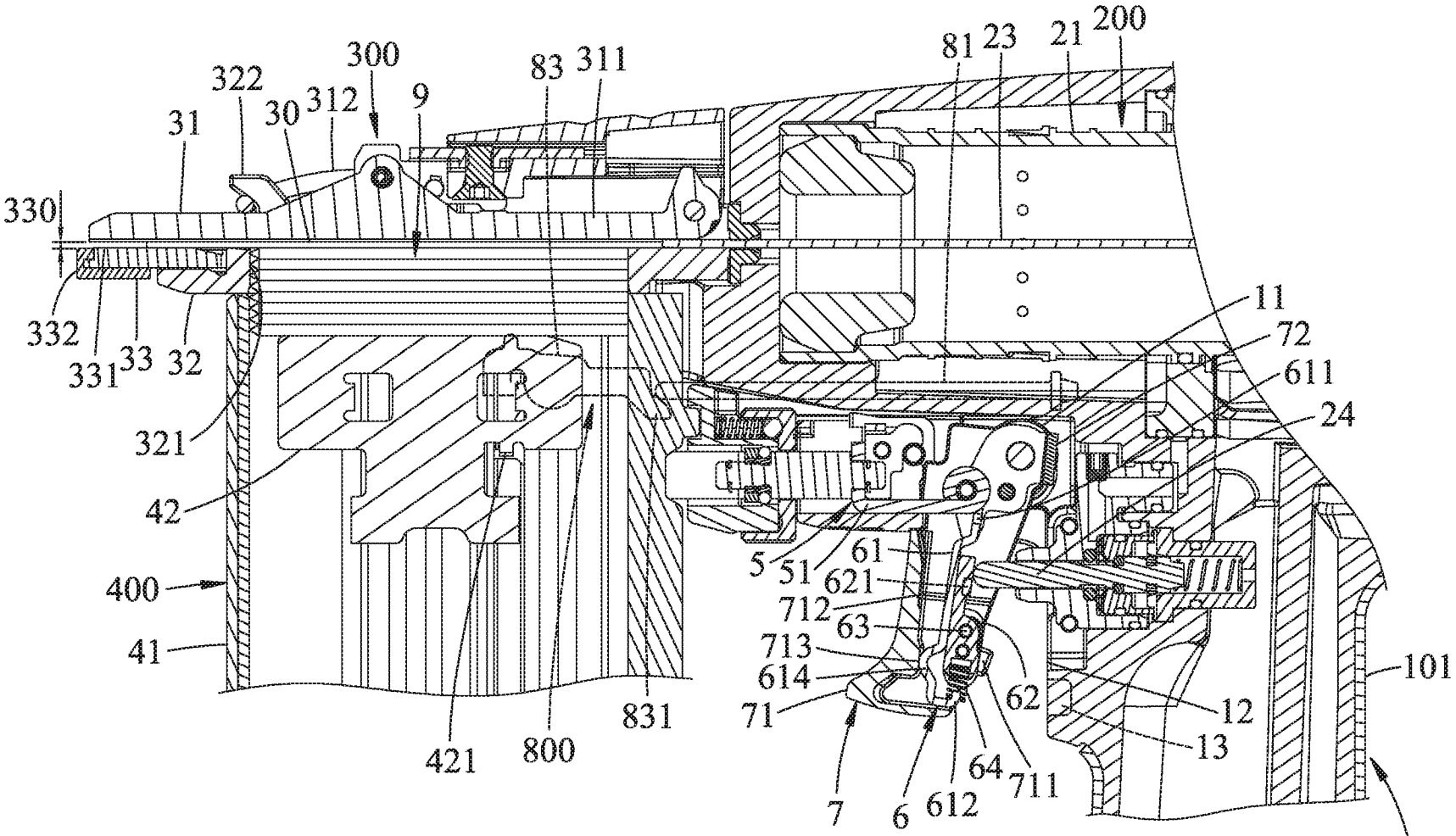
FIG. 10 is a fragmentary sectional view illustrating the trigger member at a repetitive firing position.
Figure 11:
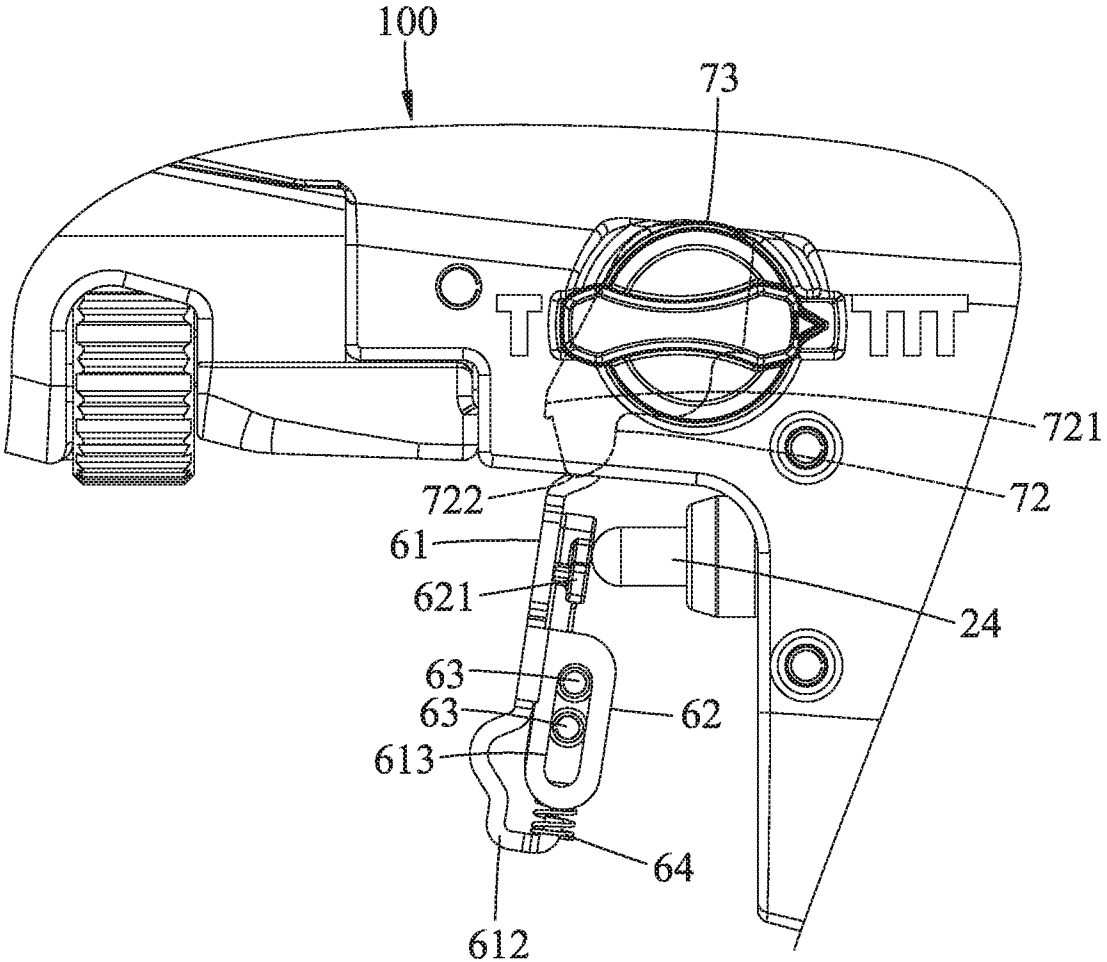
FIG. 11 is a fragmentary side view illustrating the trigger member at the repetitive firing position.

Referring to FIGS. 10 and 11, when the trigger member 71 is at the repetitive firing position, the projections 621 of the sliding block 62 are configured not to be aligned with the blocking member 72 in the front-rear direction.

Figure 12:
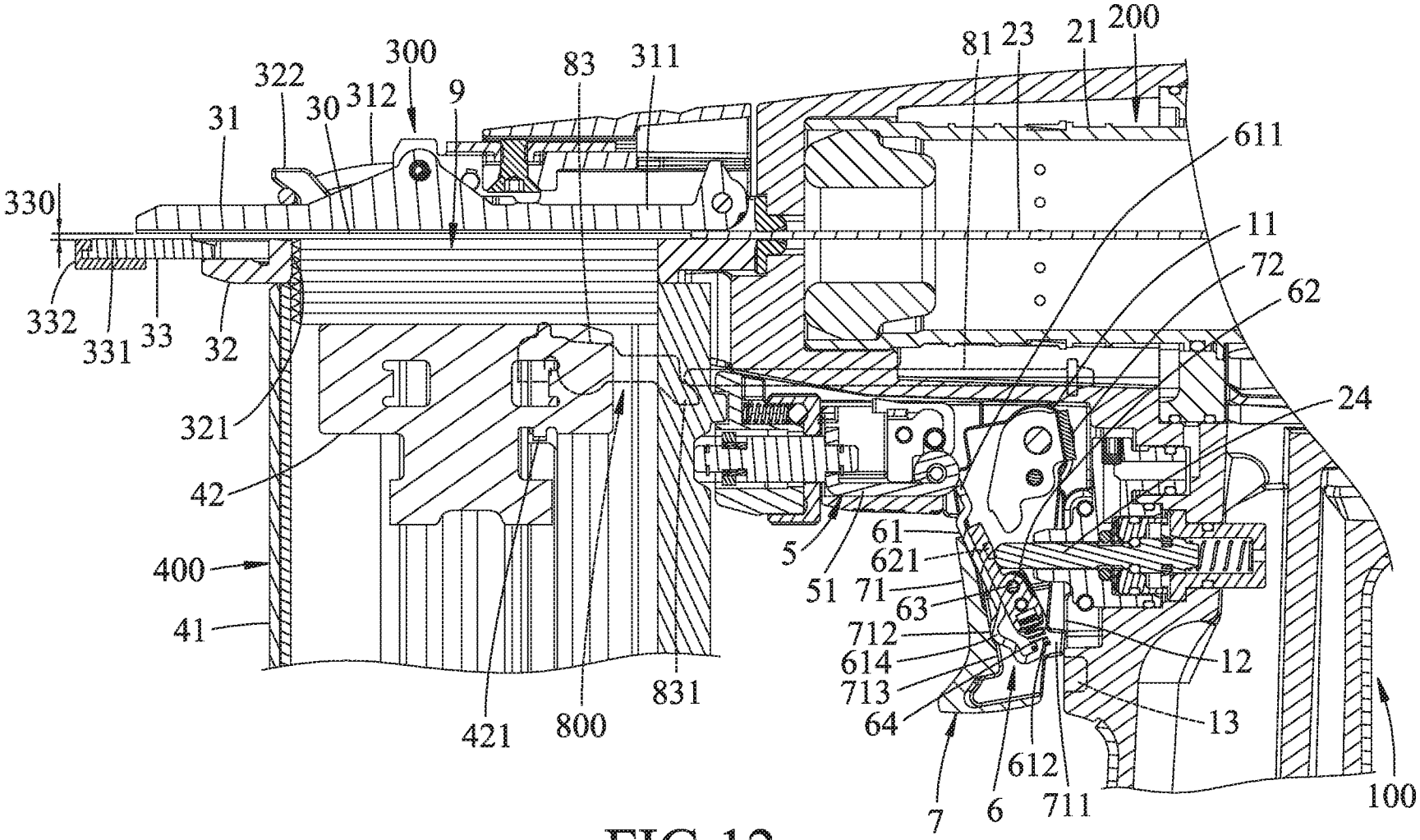
FIG. 12 is a fragmentary sectional view illustrating the trigger member at the repetitive firing position.

Referring to FIG. 12, when the trigger member 71 is at the repetitive firing position and when the trigger member 71 is depressed toward to handle 101 with the abutment front end 332 of the contact arm 33 not being pushed against an object, the trigger arm 61 is blocked by the plunger 24 and substantially rotates about the front end of the plunger 24, so that the upper portion 611 of the trigger arm 61 is permitted to move forwardly to push and move the contact arm 33 and the transmission member 51 forwardly against the biasing action of the safety resilient members 34. Since the projections 621 of the sliding block 62 are configured not to be aligned with the blocking member 72 in the front-rear direction at the time that the trigger member 71 is at the repetitive firing position, when the trigger member 71 is depressed such that the abutment portion 711 abuts against the first stop structure 12, the projections 621 of the sliding block 62 are misaligned from the blocking member 72 in the front-rear direction, and the contact arm 33 is moved forwardly away from the normal position.

Figure 13:
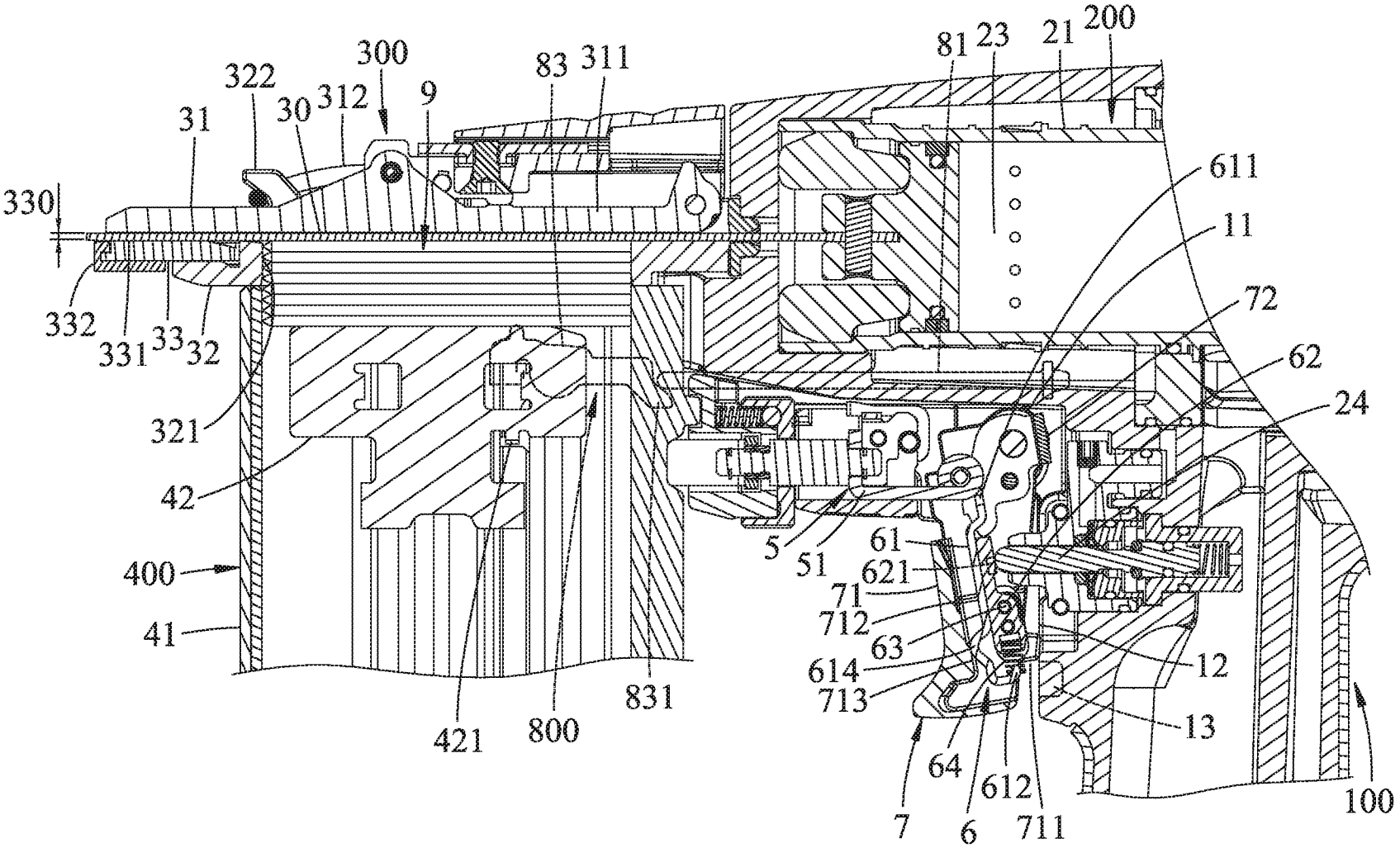
FIG. 13 is another fragmentary sectional view illustrating the trigger member at the repetitive firing position.

Referring further to FIG. 13, when the trigger member 71 is at the repetitive firing position and when the contact arm 33 is pushed against an object (not shown) to be depressed with the trigger member 71 being kept depressed, the trigger arm 61 is pushed by the rear end of the transmission member 51, so that the trigger arm 61 is permitted to push and move the plunger 24 to the activating position for activating the nail-driving operation.

During the movement of the nail gun away from the object at the instant that the nail 9 is struck, the trigger arm 61 is pushed forwardly by the plunger 24 so that the upper portion 611 of the trigger arm 61 moves and pushes the contact arm 33 and the transmission member 51 forwardly against the biasing action of the safety resilient members 34. It should be noted that, after the contact arm 33 is driven by the trigger arm 61 to project out of the gun body 100 by a maximum extent, the projections 621 of the sliding block 62 would still be misaligned from the blocking member 72 in the front-rear direction. As such, the plunger 24 can be repetitively moved to the activating position for activating the nail-driving operation upon each depression of the contact arm 33 with the trigger member 71 being kept depressed (i.e., the nail gun is in a repetitive firing model.

Since the first stop structure 12 is located ahead of the second stop structure 13, when the trigger member 71 is at the repetitive firing position, the trigger member 71 is only permitted to be rotated in a relatively small range so that the trigger arm 61 cannot move the plunger 24 to the activating position when the contact arm 33 is not pushed against an object.

Figure 14:
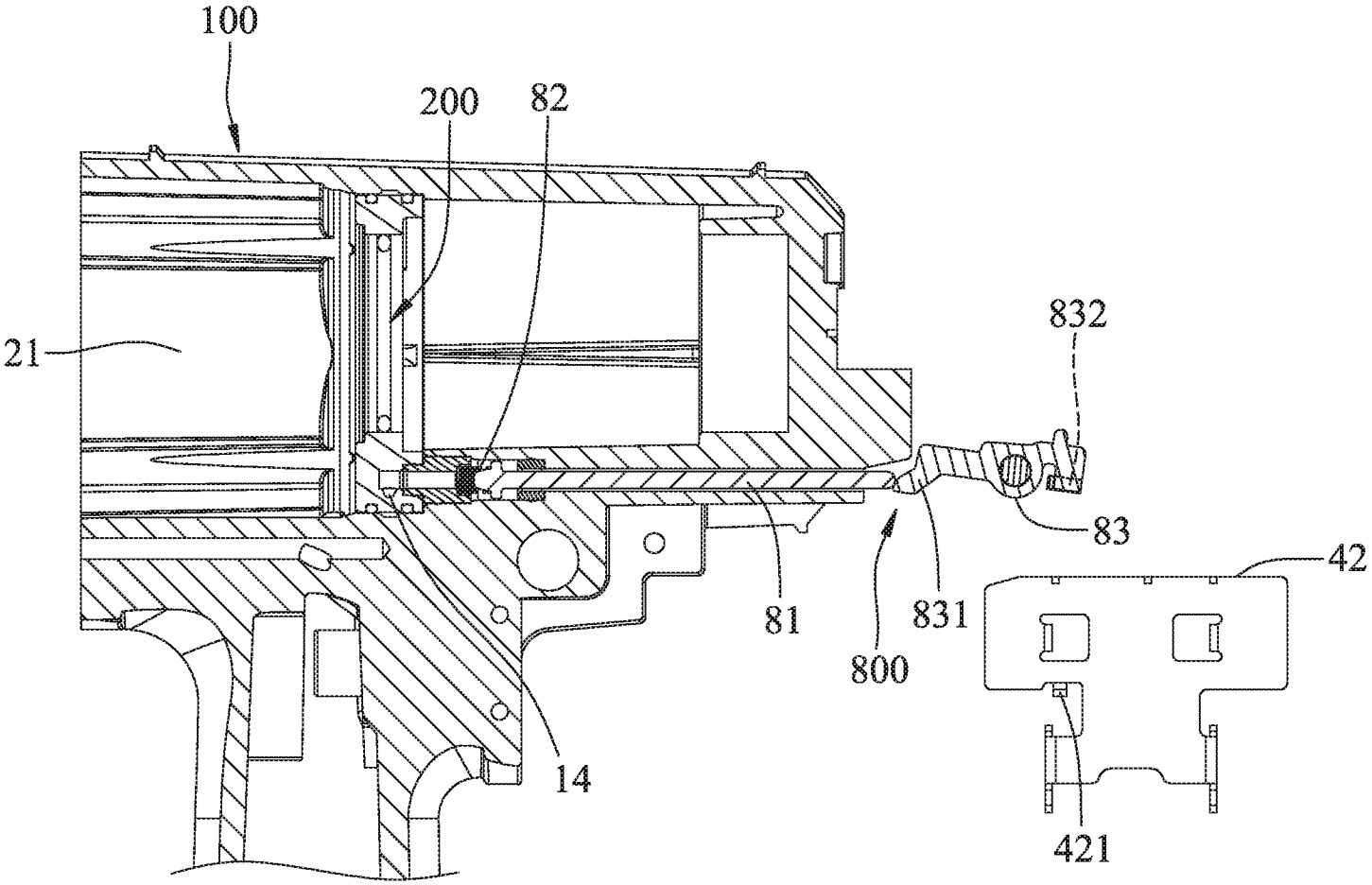
FIG. 14 is a fragmentary sectional view illustrating a detection module of the embodiment.
Figure 15:
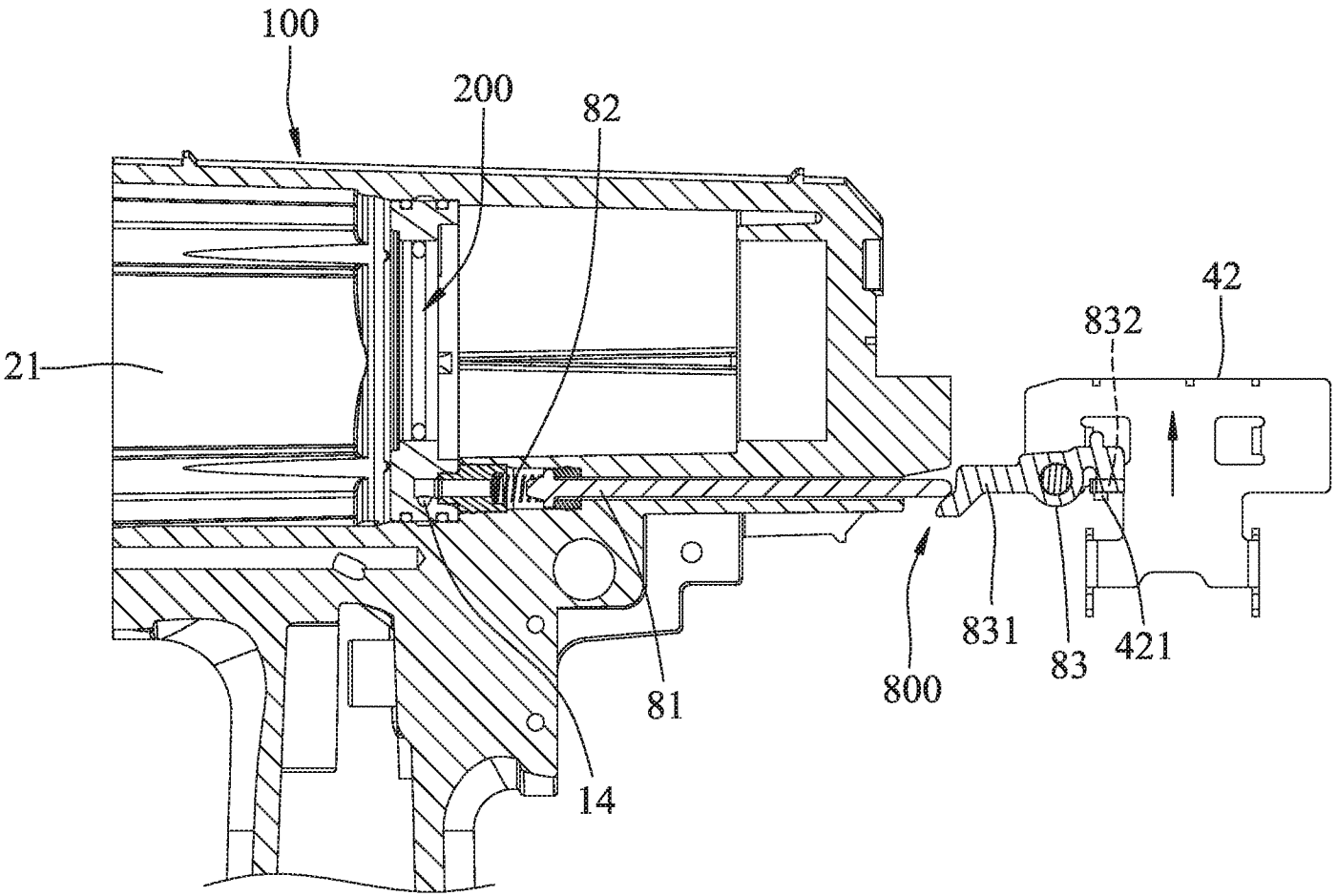
FIG. 15 is another fragmentary sectional view illustrating the detection module being pushed by a nail feeder of the embodiment.

Referring to FIGS. 1, 14 and 18, when the nail feeder 42 pushes the last nail 9 in the magazine housing 41 into the nail path 30, the projection 421 of the nail feeder 42 pushes and moves the second arm portion 832 against the biasing action of the detection resilient member 84, such that the first arm portion 831 is partially removed from the path of movement of the valve rod 81, and that the valve rod 81 is moved to the sealing position by the valve resilient member 82 to seal up the flow path 14. As such, even if the plunger 24 is moved to the activating position, the high-pressure air in the release chamber 26 cannot be released via the flow path 14 so that the head valve 25 can keep blocking the cylinder 21 and that the high-pressure air cannot flows into the cylinder 21 for striking nails (i.e., the nail-driving operation cannot be activated). Therefore, dry-firing of the nail gun can be prevented.

It should be noted that, in this embodiment, the magazine module 400 and the detection module 800 are configured such that the flow path 14 is sealed so as to prevent dry-firing when there is no nail in the magazine housing 41. In a modification, the magazine module 400 and the detection module 800 may be configured such that the flow path 14 is sealed when the amount of the nails 9 in the magazine housing 41 is less than a predetermined number.

To sum up, the switch member 73 is operable to move the trigger member 71 and the blocking member 72 relative to the trigger arm 61 and the sliding block 62 so as to switch the nail gun between the sequential firing mode and the repetitive firing mode. Moreover, the first stop structure 12 and the second stop structure 13 are respectively configured to limit the movement of the trigger member 71 when the trigger member 71 is at the repetitive firing position and the sequential firing position. As such, the plunger 24 can be adequately moved by the trigger arm 61 when the nail gun is at the sequential firing mode or the repetitive firing mode.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A nail gun comprising:

a gun body;

a power module disposed in said gun body, and configured to perform a nail-driving operation in which said power module output power to strike a nail;

a muzzle module mounted to said gun body, and including a nail exit opening and a contact arm, said contact arm having an abutment front end, and being resiliently maintained at a normal position, said contact arm being operable to move in a nail-exit direction away from the normal position such that said abutment front end projects relative to said nail exit opening; and a switchable trigger module operable to activate the nail-driving operation for firing the nail via said nail exit opening, said switchable trigger module including a transmission unit, a trigger arm unit and a trigger unit, said transmission unit including a transmission member that is connected to said contact arm, said trigger arm unit abutting against said transmission member at least in a normal state, said trigger unit including a trigger member that is pivoted to said gun body and that is movable relative to said gun body, and a blocking member that is mounted to said trigger member, said trigger member interacting with said trigger arm unit, and being operable to move between a sequential firing position and a repetitive firing position, when said trigger member is at the sequential firing position and when said trigger member is depressed with said abutment front end of said contact arm not being blocked, said trigger arm unit being configured to push said transmission member to move said contact arm away from the normal position in the nail-exit direction, and said blocking member being configured to block said trigger arm unit so as to prevent said trigger arm unit from moving in a direction opposite to the nail-exit direction, such that the nail-driving operation is prevented from being activated by operation of said contact arm;

wherein when said trigger member is at the repetitive firing position and when said trigger member is depressed with said abutment front end of said contact arm not being blocked, said trigger arm unit is configured to push said transmission member to move said contact arm away from the normal position and configured to be misaligned from said blocking member, such that said trigger arm is moved by said transmission member to activate the nail-driving operation upon movement of said contact arm in the direction opposite to the nail-exit direction.

2. The nail gun as claimed in claim 1, wherein when said trigger member is at the sequential firing position and when said trigger member is depressed with said abutment front end of said contact arm being blocked, said trigger arm unit is misaligned from said blocking member, and moves to activate the nail-driving operation.

3. The nail gun as claimed in claim 1, wherein said trigger unit further includes a switch member, said switch member being rotatably mounted to said gun body, and having an eccentric axle portion that extends through said trigger member, said trigger member and said blocking member being moved relative to said gun body when said switch member is rotated relative to said transmission member.

4. The nail gun as claimed in claim 1, wherein said muzzle module includes a cover plate, and a middle plate that cooperates with said cover plate to define a nail path therebetween, said contact arm being substantially disposed between said cover plate and said middle plate, and cooperating with said cover plate to define said nail exit opening, said nail path being adapted for receiving a nail that is pushed thereinto.

5. The nail gun as claimed in claim 4, wherein said muzzle module further includes at least one safety resilient members, said at least one safety resilient members having two opposite ends respectively abutting against said contact arm and said middle plate, said at least one safety resilient members resiliently biasing said contact arm for maintaining said contact arm at the normal position.

6. The nail gun as claimed in claim 4, wherein said cover plate includes a plate member, and a fastening assembly that is pivoted to said plate member, said middle plate being separably held by said fastening assembly so that said cover plate is removably positioned relative to said middle plate.

7. The nail gun as claimed in claim 6, wherein said middle plate has two hook portions that are respectively located at two opposite lateral sides of said cover plate, said hook portions being separably held by said fastening assembly.

8. The nail gun as claimed in claim 1, wherein said trigger arm unit includes a trigger arm, a sliding block, at least one connecting rod and a block resilient member, said trigger arm having an upper portion that is pivotally connected to said transmission member, a free lower portion that is opposite to said upper portion, and at least one elongated guide groove, said at least one connecting rod being mounted to said sliding block and slidable within said guide groove of said trigger arm, said block resilient member having two opposite ends respectively abutting against said sliding block and said trigger arm, and resiliently biasing said sliding block away from said lower portion of said trigger arm, when said trigger member is at the sequential firing position and when said trigger member is depressed with said abutment front end of said contact arm not being blocked, said sliding block and said blocking member being configured to interfere with each other, when said trigger member is at the sequential firing position and when said trigger member is depressed with said abutment front end of said contact arm being blocked, said sliding block being pushed by said blocking member to move against the biasing action of said block resilient member.

9. The nail gun as claimed in claim 8, wherein said blocking member has at least one tooth protruding toward said transmission member for blocking said sliding block, and at least one end wall at an end portion thereof distal from said gun body for pushing said sliding block.

10. The nail gun as claimed in claim 8, wherein said trigger arm further has an abutment wall that protrudes toward said trigger member, said trigger member further has a first urging surface, and a second urging surface that is disposed below said first urging surface, said first urging surface being recessed relative to said second urging surface, each of said first urging surface and said second urging surface permitting said abutment wall of said trigger arm to abut thereagainst.

11. The nail gun as claimed in claim 1, wherein said gun body has a first stop structure, and a second stop structure that is recessed relative to said first stop structure away from said muzzle module, said trigger member having an abutment portion that faces toward said first stop structure and said second stop structure, said abutment portion of said trigger member corresponding in position to said first stop structure when said trigger member is at the repetitive firing position, and corresponding in position to said second stop structure when said trigger member is at the sequential firing position.

12. The nail gun as claimed in claim 1, further comprising a magazine module and a detection module, said magazine module including a magazine housing that is connected to said muzzle module and that is adapted to receive a plurality of nails therein, and a nail feeder that is movably disposed in said magazine housing and that is adapted to move the nails into said muzzle module one at a time, said detection module including detection member that is disposed on said magazine housing and that is located on the path of movement of said nail feeder, said detection member being configured to prevent activation of the nail-driving operation when said detection member is moved by said nail feeder.

13. The nail gun as claimed in claim 12, wherein said gun body has a flow path, said nail feeder having a projection that projects toward the outside of said magazine housing, said detection module further including a valve rod that is mounted to said gun body and that is movable between an unsealing position and a sealing position, when said valve rod is at the unsealing position, said flow path being unsealed such that the activation of the nail-driving operation is permitted, when said valve rod is at the sealing position, said flow path being sealed such that the activation of the nail-driving operation is prevented, said detection member being pivoted to said magazine housing, and having a first arm portion, and a second arm portion that is located on the path of movement of said projection of said nail feeder, said first arm portion maintaining said valve rod at the unsealing position when said projection of said nail feeder is spaced apart from said second arm portion, said first arm portion permitting said valve rod to move to the sealing position when said projection of said nail feeder pushes and rotates said second arm portion.

14. A switchable trigger device adapted for use in a nail gun and for activating a nail-driving operation, the nail gun having a nail exit opening, said switchable trigger device comprising:

a contact arm disposed on the nail gun, and having an abutment front end, said contact arm being resiliently maintained at a normal position, and being operable to move away from the normal position in a nail-exit direction such that said abutment front end projects relative to the nail exit opening;

a transmission member connected to said contact arm;

a trigger arm unit abutting against said transmission member at least in a normal state; and a trigger unit including a trigger member that is pivoted to the nail gun and that is movable relative to the nail gun, and a blocking member that is mounted to said trigger member, said trigger member interacting with said trigger arm unit, and being operable to move between a sequential firing position and a repetitive firing position, when said trigger member is at the sequential firing position and when said trigger member is depressed with said abutment front end of said contact arm not being blocked, said trigger arm unit being configured to push said transmission member to move said contact arm away from the normal position in the nail-exit direction, and said blocking member being configured to block said trigger arm unit so as to prevent said trigger arm unit from moving in a direction opposite to the nail-exit direction, such that the nail-driving operation is prevented from being activated by operation of said contact arm;

wherein when said trigger member is at the repetitive firing position and when said trigger member is depressed with said abutment front end of said contact arm not being blocked, said trigger arm unit is configured to push said transmission member to move said contact arm away from the normal position and configured to be misaligned from said blocking member, such that said trigger arm is moved by said transmission member to activate the nail-driving operation upon movement of said contact arm in the direction opposite to the nail-exit direction.

15. The switchable trigger device as claimed in claim 14, wherein when said trigger member is at the sequential firing position and when said trigger member is depressed with said abutment front end of said contact arm being blocked, said trigger arm unit is misaligned from said blocking member, and moves to activate the nail-driving operation.

16. The switchable trigger device as claimed in claim 14, wherein said trigger unit further includes a switch member, said switch member being rotatably mounted to said gun body, and having an eccentric axle portion that extends through said trigger member, said trigger member and said blocking member being moved relative to said gun body when said switch member is rotated relative to said transmission member.

17. The switchable trigger device as claimed in claim 14, wherein said trigger arm unit includes a trigger arm, a sliding block, at least one connecting rod and a block resilient member, said trigger arm having an upper portion that is pivotally connected to said transmission member, a free lower portion that is opposite to said upper portion, and at least one elongated guide groove, said at least one connecting rod being mounted to said sliding block and slidable within said guide groove of said trigger arm, said block resilient member having two opposite ends respectively abutting against said sliding block and said trigger arm, and resiliently biasing said sliding block away from said lower portion of said trigger arm, when said trigger member is at the sequential firing position and when said trigger member is depressed with said abutment front end of said contact arm not being blocked, said sliding block and said blocking member being configured to interfere with each other, when said trigger member is at the sequential firing position and when said trigger member is depressed with said abutment front end of said contact arm being blocked, said sliding block being pushed by said blocking member to move against the biasing action of said block resilient member.

18. The switchable trigger device as claimed in claim 17, wherein said blocking member has at least one tooth protruding toward said transmission member for blocking said sliding block, and at least one end wall at an end portion thereof distal from said gun body for pushing said sliding block.

19. The switchable trigger device as claimed in claim 18, wherein said trigger arm further has an abutment wall that protrudes toward said trigger member, said trigger member further has a first urging surface, and a second urging surface that is disposed below said first urging surface, said first urging surface being recessed relative to said second urging surface, each of said first urging surface and said second urging surface permitting said abutment wall of said trigger arm to abut thereagainst.

20. The switchable trigger device as claimed in claim 14, the nail gun including a cover plate, and a middle plate that cooperates with the cover plate to define a nail path therebetween, wherein, said contact arm is substantially disposed between the cover plate and the middle plate, and is adapted to cooperate with the cover plate to define the nail exit opening.

21. The switchable trigger device as claimed in claim 20, further comprising at least one safety resilient members, said at least one safety resilient members having two opposite ends respectively abutting against said contact arm and said middle plate, said at least one safety resilient members resiliently biasing said contact arm for maintaining said contact arm at the normal position.

22. The switchable trigger device as claimed in claim 14, the nail gun having a first stop structure, and a second stop structure that is recessed relative to the first stop structure away from the nail exit opening, wherein, said trigger member has at least one abutment portion that faces toward the first stop structure and the second stop structure, said abutment portion of said trigger member being adapted to correspond in position to the first stop structure when said trigger member is at the repetitive firing position, and to correspond in position to the second stop structure when said switch member is at the sequential firing position.

* * * * *